United States Patent [19]

Hung

[11] Patent Number: 4,742,991

[45] Date of Patent: May 10, 1988

[54] LYING TYPE OF JACK STRUCTURE

[76] Inventor: Michael Hung, 11th Fl., 624 Ming Chuan E. Rd., Taipei, Taiwan

[21] Appl. No.: 882,528

[22] Filed: Jul. 7, 1986

[51] Int. Cl.[4] ..... B66F 5/04
[52] U.S. Cl. ..... 254/8 B
[58] Field of Search ..... 254/2 B–8 B, 254/2 R, 2 C, 93 R

[56] References Cited

U.S. PATENT DOCUMENTS

| | | | |
|---|---|---|---|
| 2,674,851 | 4/1954 | Wooley | 254/93 H |
| 3,181,836 | 5/1965 | Arnes et al. | 254/8 B |
| 3,807,694 | 4/1974 | Butorac | 254/8 B |
| 4,210,314 | 7/1980 | Carroll et al. | 254/8 B |

FOREIGN PATENT DOCUMENTS 2108924 5/1983 United Kingdom .

*Primary Examiner*—Frederick R. Schmidt
*Assistant Examiner*—Judy J. Hartman
*Attorney, Agent, or Firm*—Wenderoth, Lind & Ponack

[57] ABSTRACT

A jack structure, particularly an improved lying type of jack structure, has the front end of the hydraulic cylinder of the jack fixed in place with an arch-shaped plate. When the extension rod of the hydraulic cylinder is driven, the pulling rods raise the lifting arm, and the extension rod generates downward and upward components of force. By means of the arch-shaped plate and a holding member on the tail portion of the cylinder, the joint parts on the front and rear ends of the hydraulic cylinder are not pulled apart to become disengaged by the one-way stress which would cause a leak.

3 Claims, 6 Drawing Sheets

LYING TYPE OF JACK STRUCTURE

BACKGROUND OF THE INVENTION

In the conventional jack, the hydraulic cylinder, and pulling arm on the end of the extension rod are usually installed directly under the lifting arm. When the extension rod drives the pulling rod, the pivotally connected ends of the extension rod and the pulling rod are on a horizontal displacing point. The hydraulic cylinder can only be fixed in place at its rear end; therefore, when the hydraulic cylinder applys pressure to drive the extension rod, the load on the lifting arm causes the joint portions on both front and rear ends of the hydraulic cylinder to become disengaged as a result of a change in the relative angle between the pulling rod and and the elbow to generate a one-way vertical component of force. Consequently, the hydraulic cylinder is liable to leak.

SUMMARY OF THE INVENTION

This invention relates to a jack, of which the hydraulic cylinder is free from being subjected to a vertical component of force. According to the present invention, the front ring-shaped portion of the hydraulic cylinder is placed on a beam, and then is fastened in place with an arch-shaped plate which is in turn subjected to the force to be applied to the hydraulic cylinder, and which provides an improvement in the joint portions on both the front and rear ends of the hydraulic cylinder by preventing the cylinder from being affected by the vertical force which causes leaking.

DESCRIPTION OF PREFERRED EMBODIMENT

Figure 1:
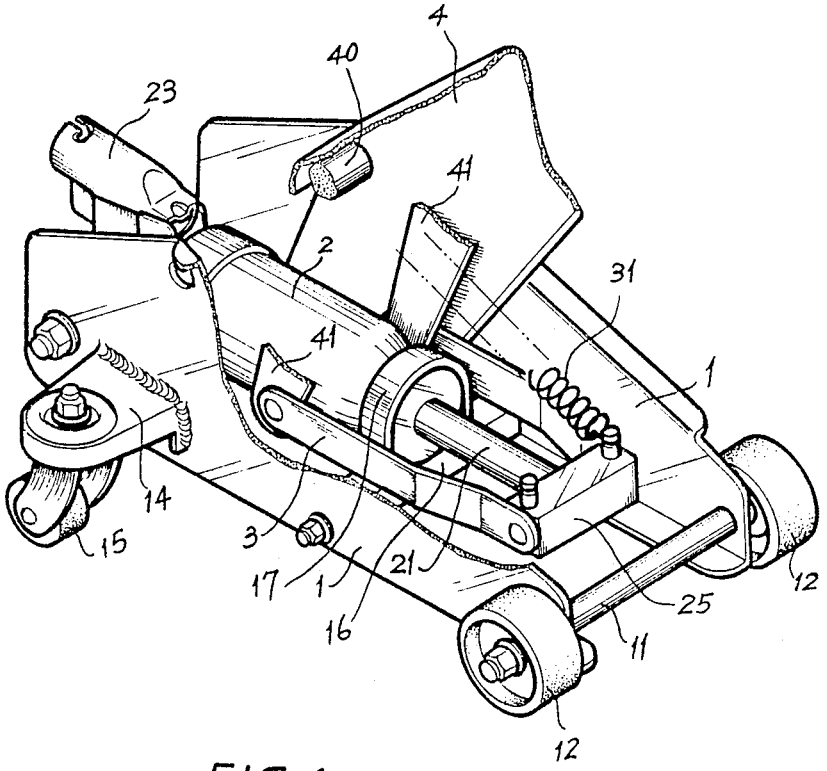
FIG. 1 is a perspective of the jack according to the present invention.

Referring to FIG. 1, there is shown a perspective view of a lying type of jack according to the present invention, which comprises mainly side frames 1, the hydraulic cylinder 2, the pulling rod 3, and the lifting arm 4.

Figure 2:
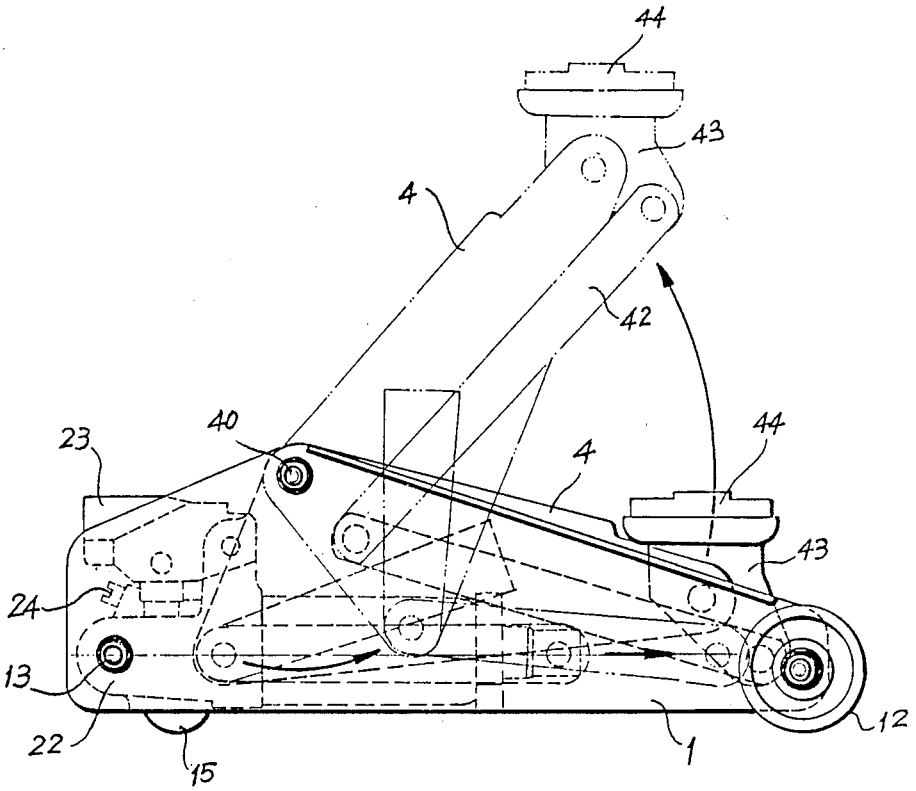
FIG. 2 is a side view of the jack according to the present invention.

The side frames 1 as shown in FIG. 1 or 2 are made from strong steel plates pressed into form; the top edge of the side frame is bent outwards into a narrow flat flange, while the bottom edge of the side frame is bent inwards into a narrow flat flange. The front ends of the two side frames 1 are mounted with a shaft 11 for mounting two wheels 12. On the rear end of the side frame, there is a holding rod 13. In front of the holding rod 13, there are two lugs 14 on the side frames respectively for mounting casters 15. In the middle portion of and between the two side frames 1, there is a beam 16 fixed in place with screw bolt so as to support the hydraulic cylinder 2. On the spot where the hydraulic cylinder rests, there is provided an arch-shaped plate 17 for fastening the round front end of the hydraulic cylinder 2. By means of the plate 17, the extension rod 21 of the hydraulic cylinder 2 is limited to move horizontally.

The tail portion of the hydraulic cylinder 2 has a holding ring 22 to support the holding rod 13, while the front end of the cylinder 2 is fixed in place with an arch-shaped plate 17 so as to fix the cylinder 2 in a horizontal position. The driving member of cylinder 2 includes a driving tube 23 and a bleeding valve 24 mounted on the holding ring 22. One end of the extension rod 21 is fixed to the middle portion of a sliding block 25 for pulling the pulling rod 3 when the extension rod 21 is extended horizontally.

The pulling rods 3 are mounted along the both sides of the extension rod 21 but within the two side frames 1 respectively as shown in FIGS. 1, 2, 3 or 4. One end of each of the pulling rods 3 is pivotally connected with the sliding block 25 and the lower end of the fixing elbow 41 so as to form a special elbow mechanism, on which a return spring 31 is mounted by means of a screw bolt. The other end of the return spring 31 is fixed to the pivot 40 on the lifting arm 4, and when the hydraulic cylinder 2 is released, the extension rod 21 is pulled back by the return spring 31.

Figure 3:
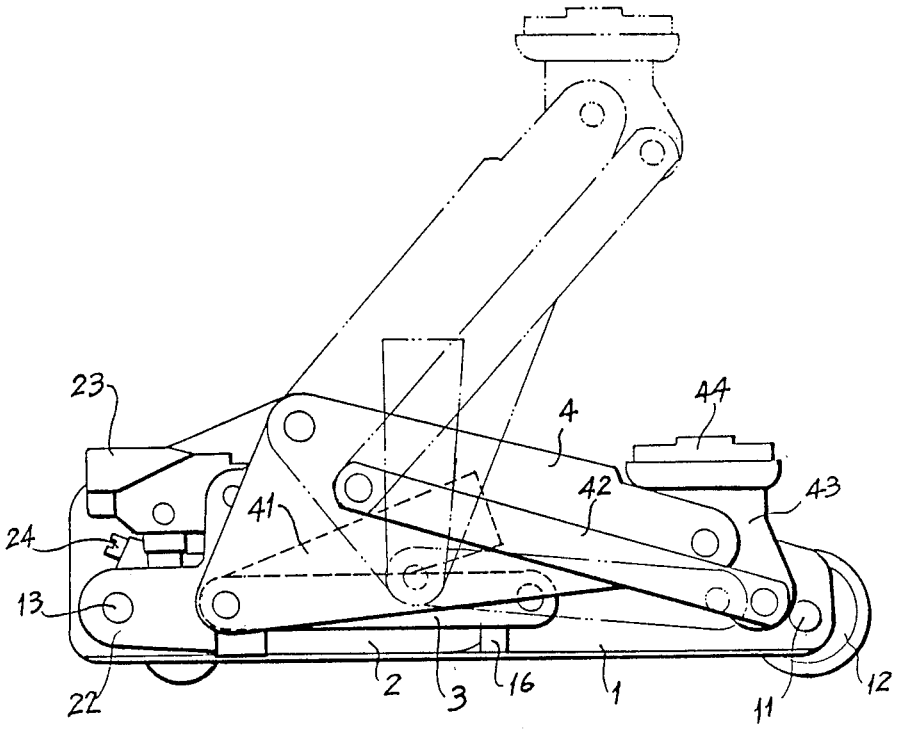
FIG. 3 illustrates the operation steps of the jack with one side frame being removed.
Figure 4:
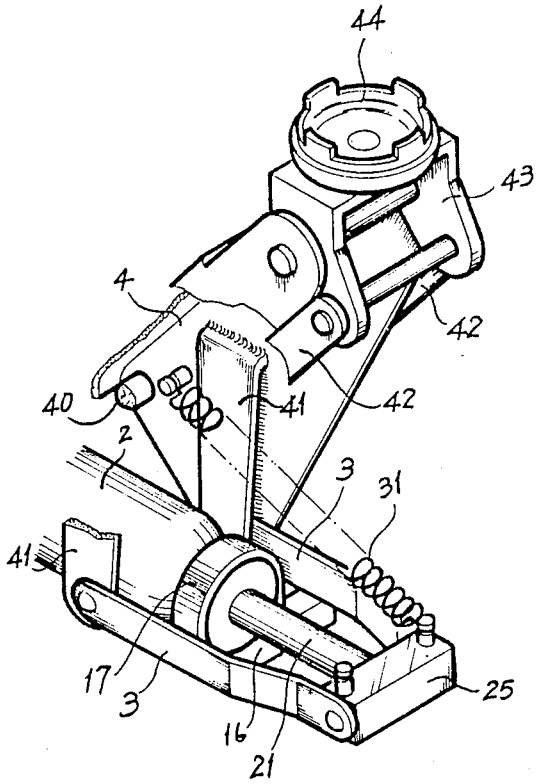
FIG. 4 illustrates the relative positions among the lifting arm, the pulling rod, and the hydraulic cylinder in the present invention.

The lifting arm 4 includes a triangle-shaped lifting arm 4, a fixed elbow 41, a balance rod 42, a disk seat 43, and a lifting disk 44 as shown in FIGS. 1, 3 or 4. The lifting arm 4 looks like a frame, having a flat back; on one corner thereof, there is a pivot 40 to attach the arm 4 to the top portion of the two side frames 1. The top portion of the fixed elbow 41 is welded to the inner side of the lifting arm 4. The other end of the fixed elbow 41 extends downwards to another triangle portion of the lifting arm 4, and is pivotally connected together to the pulling rod 3. The top end of the lifting arm 4 is pivotally connected with a balance rod 42 for maintaining the disk seat 43 and the lifting disk 44 in a level position.

The aforesaid lying type of improved jack is driven with a hydraulic cylinder horizontally placed at the bottom portion of the two side frames 1. When the driving tube 23 is driven with an operating rod, the extension rod 21 will extend horizontally. Simultaneously, the pulling rod 3 will pull the bottom end of the fixed elbow 41 to cause the lifting arm 4 to move forward and to raise the lifting disk 44 gradually upwards.

Upon the hydraulic cylinder being operated, the pulling rod 3 will pull the sliding block 25 forward, and the extension rod 21 will be raised together with the lifting arm 4, i.e. a downward component of force being generated before an upward component of force. The holding points of the front and rear ends of the hydraulic cylinder can bear and offset the component of forces so as to prevent the joint portions of the both ends from separating to form a gap therebetween that may cause a leak by a constant directional force.

FIG. 3 illustrates the relative positions between the fixed elbow 41 and the pulling rod 3 upon the lifting arm 4 being at different positions; it also shows the different stress directions upon a pushing force being applied thereto.

The stress direction applied to the hydraulic cylinder 2 upon the lifting arm 4 being set at the lowest and the highest positions is described as follows.

Figure 5:
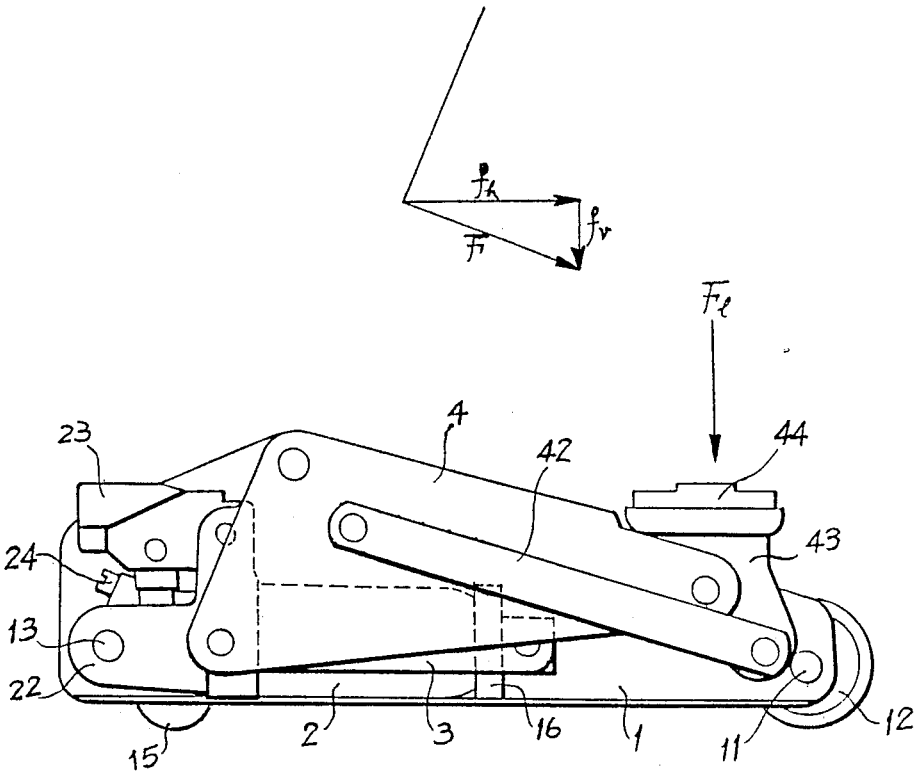
FIG. 5 is a side view of the jack, showing the lifting arm in the lowest position.

FIG. 5 illustrates that when the jack lifts a load, the lifting disk is subjected to a downward external force El. The portion from the end of the elbow 41 to the pivot 40 forms a force-applying arm, which is not perpendicular to the horizontal line as shown in the force-analysis diagram. In order to balance the external force Fl, the end of the force-applying arm (the pivoted point between the elbow and the pulling rod) must have a vertical force F subjected thereto, and that forced applied is to be born by the hydraulic cylinder 2. The force F may be divided into fv and fh, i.e., the components of force applied to the pulling rod 3. Particularly, the force fv would force the extension rod 21 downwards, whereby both of the ends of the hydraulic cylinder 2 may be pulled to separate from each other to cause a leak, and this is quite often the case. In the present invention, however, both of the ends of the hydraulic cylinder have been fastened respectively and properly to the joint portion of the hydraulic cylinder.

Figure 6:
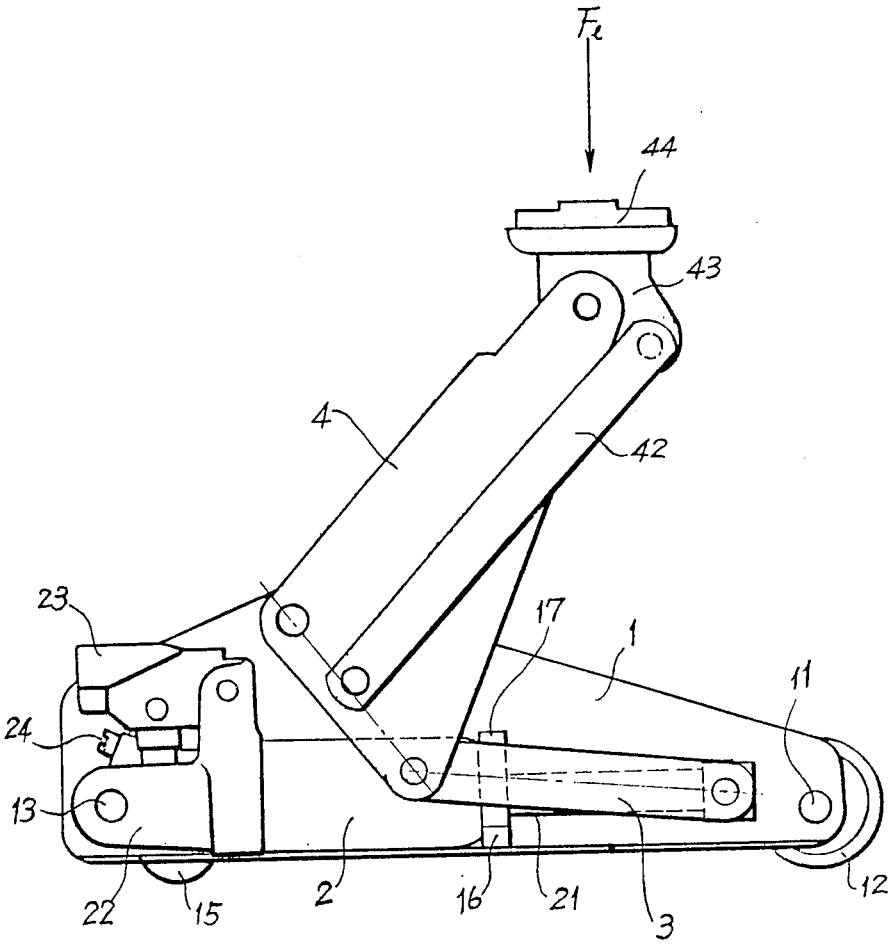
FIG. 6 is a side view of the jack, showing the lifting arm in the highest position.

FIG. 6 illustrates that, when the lifting arm 4 is raised to an angle over 90° between the end of elbow 41 and the pulling rod 3, the force-applying arm of the lifting arm 4 exerts a vertical force F, which is a slanting and upward force, and the component of force fv thereof is also applied upwards. Therefore, upon the hydraulic cylinder being driven, the pulling rod 3 will be pulled upwards to cause the sliding block 25 to move upwards. In that case, the hydraulic cylinder 2 is subjected to an upward component of force, which would cause the both ends of the hydraulic cylinder 2 to separate and to leak. According to the present invention, both ends of the hydraulic cylinder 2 are furnished with an arch-shaped plate and a holding rod to offset the component of force so as to maintain the hydraulic cylinder in an integral manner.

In the aforesaid two conditions, the angle ratio of the upward component of force to the downward component of force during the raising period of the lifting arm 4 is about 3:2. Therefore, the upward component of force would usually not be developed to the maximum limit, i.e., the raising angle does not usually reach an extremity. In other words, it is possible to have a slanting and upward force-applying angle in most cases so as to maintain a moderate and even upward and downward change of component of force to apply an average force to the hydraulic cylinder.

I claim:

1. A lying type hydraulic jack structure for vertically lifting and supporting an object, said jack structure comprising:

a pair of side frames;

a hydraulic cylinder fixedly mounted to said pair of side frames and extending in a horizontal direction, said hydraulic cylinder having a joint portion on at least one end thereof;

an extendable and retractable extension rod slidably mounted within the hydraulic cylinder and extending therefrom in said horizontal direction to a free end thereof;

a lifting arm pivotably mounted to said pair of side frames at a pivot about which said lifting arm pivots to lift the object vertically;

a pulling rod pivotally mounted at one end thereof to the free end of the extension rod and at the other end thereof to said lifting arm at a location thereon that is spaced from said pivot, said extension rod extending and retracting to move said pulling rod pivotally mounted at the free end thereof which in turn pivots the lifting rod pivotally connected to said other end thereof about said pivot to lift and lower the object; and fixing means for immovably fixing said hydraulic cylinder on the jack so as to extend in the horizontal direction relative to said pair of side frames, said fixing means comprising a first support means attached to the cylinder adjacent said one end thereof and a second support means immovable relative to the side frames and attached to the cylinder adjacent the other end thereof for inhibiting the load that is exerted by the object which acts through the lifting arm and the pulling rod from acting on the cylinder at the at least one joint portion; and wherein said second support means comprises a beam attached to said pair of side frames on which the hydraulic cylinder is supported and an arch-shaped plate being attached to the beam and extending over said hydraulic cylinder.

2. A jack structure as claimed in claim 1, wherein said first support means is a holding rod extending between and fixed to said pair of side frames.

3. A jack structure as claimed in claim 2, wherein said second support means comprises a beam on which the hydraulic cylinder is supported and an arch-shaped plate extending over said hydraulic cylinder and attached to said beam.

* * * * *